US008544647B2

(12) United States Patent
Kelleman

(10) Patent No.: US 8,544,647 B2
(45) Date of Patent: Oct. 1, 2013

(54) PACKAGING ARRANGEMENT INCLUDING A WALLET AND METHOD FOR PACKAGING A WALLET

(76) Inventor: Terrence Kelleman, Brooklyn, NY (US)

( * ) Notice: Subject to any disclaimer, the term of this patent is extended or adjusted under 35 U.S.C. 154(b) by 0 days.

(21) Appl. No.: 13/187,294

(22) Filed: Jul. 20, 2011

(65) Prior Publication Data

US 2013/0020231 A1 Jan. 24, 2013

(51) Int. Cl.
*B65D 25/54* (2006.01)

(52) U.S. Cl.
USPC ..... 206/495

(58) Field of Classification Search
USPC ..... 206/495, 293, 292, 296, 806; 150/131, 150/132
See application file for complete search history.

(56) References Cited

U.S. PATENT DOCUMENTS

| | | | | | |
|---|---|---|---|---|---|
| 1,014,104 | A * | 1/1912 | Eager | 150/136 |
| 1,238,898 | A * | 9/1917 | Eager | 206/292 |
| 2,519,706 | A * | 8/1950 | Ryan | 206/408 |
| 2,573,827 | A * | 11/1951 | Bigelow | 53/429 |
| 2,696,295 | A * | 12/1954 | Berry | 206/232 |
| 2,706,041 | A * | 4/1955 | Tate | 206/348 |
| 2,839,185 | A * | 6/1958 | Isaacs | 206/49 |
| 2,965,227 | A * | 12/1960 | Caulfield | 206/296 |
| 4,120,395 | A * | 10/1978 | Mandel et al. | 206/63.3 |
| 4,214,661 | A * | 7/1980 | Turetsky et al. | 206/466 |
| 4,945,961 | A * | 8/1990 | Healy | 150/132 |
| 5,772,087 | A * | 6/1998 | Kolton | 223/1 |
| 5,775,504 | A * | 7/1998 | Menaged | 206/495 |
| 6,032,793 | A * | 3/2000 | Oakley | 206/296 |
| 6,053,326 | A | 4/2000 | Ford | |
| 6,749,060 | B2 | 6/2004 | Ford | |
| 6,854,597 | B1 * | 2/2005 | Ali et al. | 206/349 |
| 7,143,892 | B2 * | 12/2006 | Kolton et al. | 206/6.1 |
| 7,451,879 | B2 | 11/2008 | Ford | |
| 2001/0022318 | A1 * | 9/2001 | Kaden et al. | 229/80 |
| 2006/0060492 | A1 * | 3/2006 | Sethi et al. | 206/495 |

FOREIGN PATENT DOCUMENTS

AU 2009100937 B4 10/2009

* cited by examiner

*Primary Examiner* — Steven A. Reynolds
*Assistant Examiner* — King M Chu
(74) *Attorney, Agent, or Firm* — Michael A. Adler; Davidoff Hutcher & Citron LLP

(57) ABSTRACT

Packaging arrangement includes a wallet having an internal channel and an insert arranged partly in the channel and having first and second portions extending outward from respective ends of the wallet, and each of which includes at least one aperture on an alignment region. The apertures in the alignment regions align with one another to thereby form a suspension aperture that enables the packaging arrangement to be suspended for retail sale. A grommet may be arranged in the suspension aperture to facilitate such suspension. A method for forming the packaging arrangement is also disclosed.

11 Claims, 2 Drawing Sheets

FIG. 1
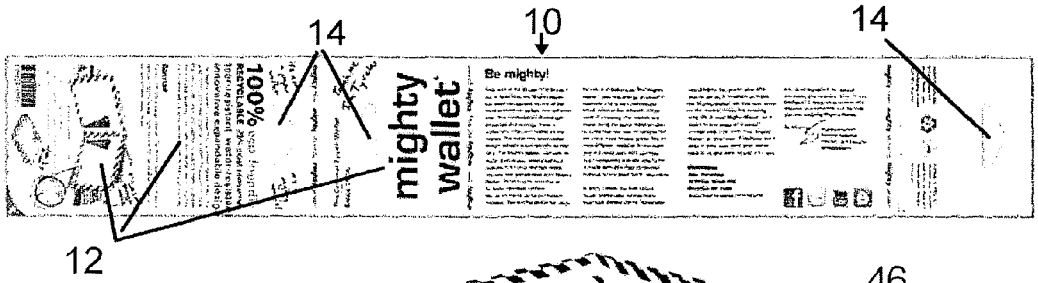
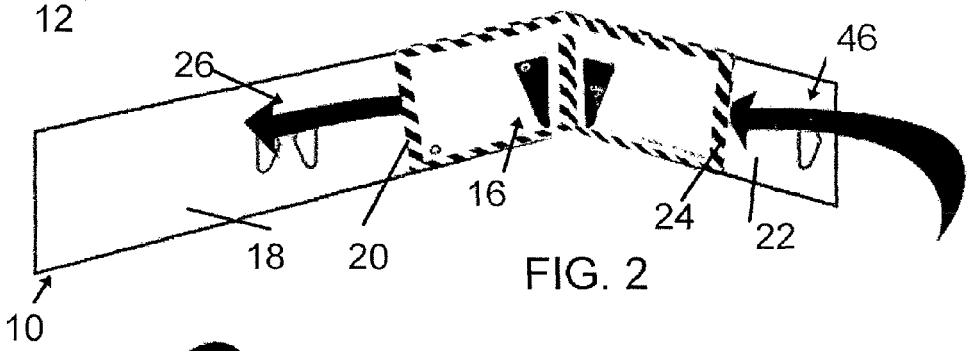
FIG. 2
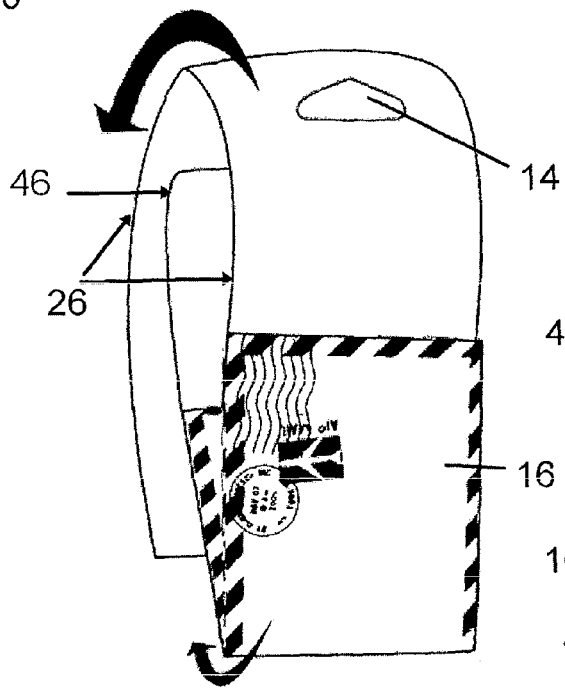
FIG. 3
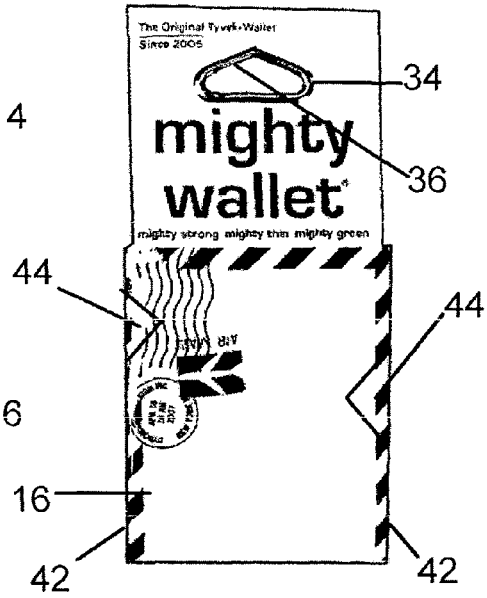
FIG. 4

PACKAGING ARRANGEMENT INCLUDING A WALLET AND METHOD FOR PACKAGING A WALLET

FIELD OF THE INVENTION

The present invention relates to a packaging arrangement including a wallet and a method for packaging a wallet for display and sale.

BACKGROUND OF THE INVENTION

It is often desirable to package a wallet, billfold and the like to enable convenient display thereof and also at times, to prevent theft thereof. To this end, Ford, in U.S. Pat. No. 6,749,060, describes a display package that is capable of holding a wallet, billfold and the like, and is also capable of holding a wristwatch that is sold in combination with the wallet, billfold and the like. The display package comprises a generally planar strip of foldable material having several panels, a front one of which includes an opening to enable the package to be hung or suspended for retail sale. Other panels cooperate to extend through the folds of the wallet to retain the wallet in connection with the planar strip.

Also Ford, in U.S. Pat. No. 6,053,326, describes a package for a wallet, billfold and the like that comprises a box, a securement strap or band and an insert. The band is in the form of a loop that extends through openings in the box to secure the insert in the box by including a portion of the insert in the loop. No means appear to be provided to enable the package to be hung or suspended for retail sale.

Further, Ford et al., in U.S. Pat. No. 7,451,879, describe a package that comprises a tray and a housing that has one position in which it serves as a receptacle for the tray and another position in which it serves as a cover or lid for the tray. The tray has an open box-like construction that includes a hollow interior into which the wallet or billfold is placed. The package is suspended by a strip having an opening and that is attached to the housing. The structure of the package does not extend into and through the wallet or billfold and therefore theft of the wallet or billfold should still be a problem because the wallet or billfold may be stolen by breaking the tray or housing.

Kolton, in U.S. Pat. No. 5,772,087, describes a one-piece hangar including a retaining portion capable of retaining a wallet in a manner in which the wallet can be inspected without removing the wallet from the hangar, and a hook portion that enables the hangar to be hung or suspended for display and retail sale.

Sethi et al., in U.S. Pat. Appln. Publ. No. 2006/0060492, describe a similar display device including a hook section with a through opening that receives a hook or hanging member of a display structure, and a wallet retaining through which a wallet is partially inserted. The wallet is suspended from the wallet-retaining opening.

Finally, Australian Pat. Appln. No. 2009100937 describes a device for presenting information including a wallet and a substantially planar information panel that slides into and out of the wallet.

The foregoing patent publications do not disclose packaging that adequately secures a wallet, and in particular one with an internal through channel, in combination with the means that enable the wallet to be hung or suspended from a display apparatus, for example, for retail sale. Therefore, it would be desirable to provide a packaging arrangement that is integrated with the particular wallet and also provides means for the wallet to be hung or suspended.

SUMMARY OF THE INVENTION

In accordance with the invention, a packaging arrangement includes a wallet having an internal channel and an insert extending through the channel and that has first and second portions extending outward from respective first and second ends of the wallet. The first and second portions of the insert each include an alignment region and at least one aperture arranged therein. The apertures in the alignment regions align with one another to thereby form a suspension aperture that enables the packaging arrangement to be suspended for retail sale. A grommet may be arranged in the suspension aperture to facilitate such suspension.

In one embodiment, a sleeve, preferably made of a transparent material such as clear plastic, is arranged around the wallet and enables viewing of the wallet while displayed. Lateral sides of the sleeve may be attached together, e.g., by stickers, to provide a compact form for the packaging arrangement.

A method for packaging a wallet having an internal channel includes placing an insert into the channel such that a first portion of the insert extends outward from a first end of the wallet and a second portion of the insert extends outward from a second end of the wallet opposite to the first end, aligning alignment regions of the first and second portions of the insert, and then attaching the aligned alignment regions of the insert to one another, e.g., via a grommet that extends through the alignment regions.

More specifically, the insert may be constructed with an aperture on each alignment region so that aligning the alignment regions entails positioning the alignment regions so that the apertures are alongside and in alignment with one another. The grommet is then placed in the aligning apertures which, in combination, form a suspension aperture.

In one embodiment, the insert includes two apertures on the alignment region of the first portion of the insert and a single aperture on the alignment region of the second portion of the insert. In this case, aligning the alignment region of the first and second portions of the insert entails folding the insert between the two apertures on the alignment region of the first portion of the insert and inserting the alignment region of the second portion of the insert between the folded alignment region of the first portion of the insert to thereby align the three apertures with the apertures on the alignment region of the first portion of the insert sandwiching the aperture on the alignment region of the second portion of the insert.

As used herein, a wallet encompasses not only a wallet but also a billfold and other types of articles used to carrying items and that are provided with an internal through channel.

BRIEF DESCRIPTION OF THE DRAWINGS

For a better understanding of the present invention, reference is made to the following description and accompanying drawings, while the scope of the invention is set forth in the appended claims:

FIG. 1 is a front view of an insert used in the packaging arrangement and packaging method in accordance with the invention;

FIG. 2 is a view showing insertion of the insert shown in FIG. 1 into a wallet in accordance with the invention;

FIG. 3 is a view showing folding of the assembly of the wallet and insert shown in FIG. 2;

FIG. 4 is a front view of the packaging arrangement in accordance with the invention;

DETAILED DESCRIPTION OF THE INVENTION

Figure 5:
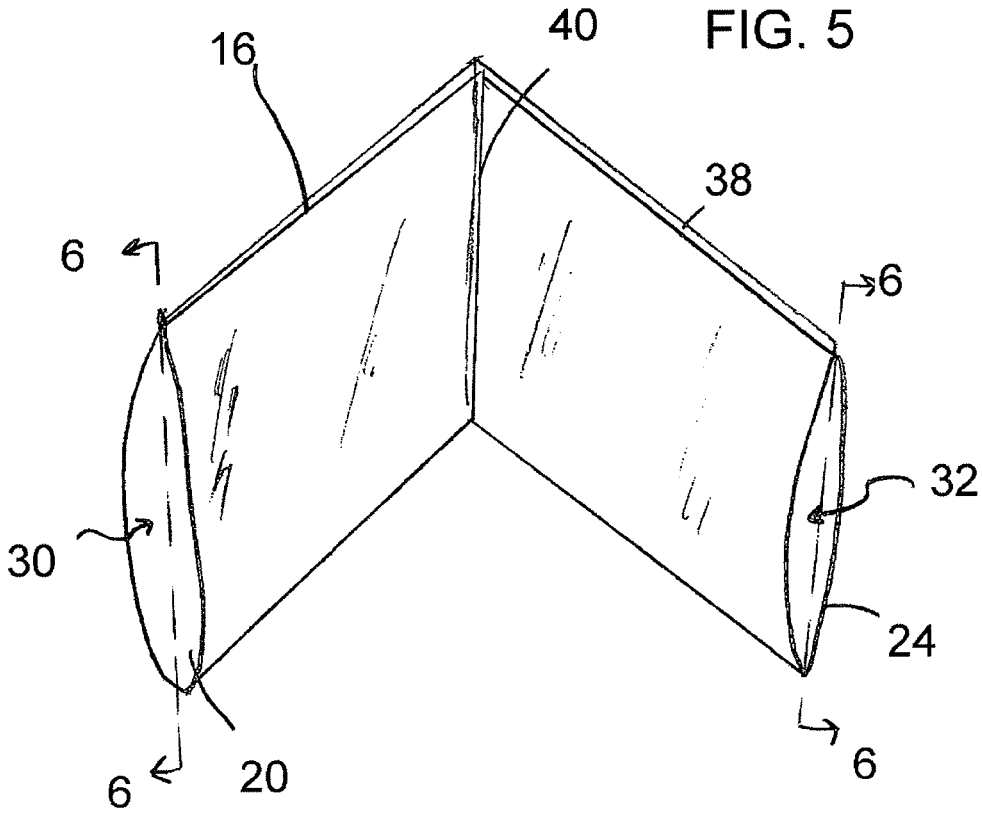
FIG. 5 is a perspective view of a wallet used in the invention.

Referring to the accompanying drawings wherein like reference numbers refer to the same or similar elements, FIG. 1 shows an insert 10 that is used to package a wallet in accordance with the invention. Insert 10 is a generally planar strip of material that has a generally rectangular shape with a length dependent on the length of the wallet and a width that is also dependent on the size of an internal channel in the wallet through which the insert 10 will be placed (see FIGS. 5 and 6, discussed below). The length of the insert 10 also depends on the desired dimension of a portion of the insert that includes the mechanism to suspend the packaging (that portion above the wallet as shown in FIG. 4).

Insert 10 is preferably made of a bendable or flexible material to enable it to be bent to form the packaging, in a manner described below. Further, printed matter 12 is optionally provided on one side of the insert 10, as shown in FIG. 1, relating, for example, to the wallet such as advantages thereof.

Apertures 14 are formed in the insert 10, e.g., die cut therein, to enable a wallet packaged using the insert 10 to be suspendable for retail sale. The size and shape of the apertures 14 varies as desired.

Referring now to FIGS. 2-4, different steps of a method for integrating the insert 10 into a wallet 16 to form the packaging arrangement and enable the wallet 16 to be suspendable for retail sale are depicted. In a first step shown in FIG. 2, the insert 10 is placed into an internal through channel of the wallet 16 such that a first portion 18 of the insert 10 is passed entirely through the channel 28 and extends outward from a first end 20 of the wallet 16 and a second portion 22 of the insert 10 extends outward from a second end 24 of the wallet 16 opposite to the first end 20 (see also FIG. 6). That is, the insert 10 is inserted through the second end 24 of the wallet 16 in a direction toward the first end 20 but is not entirely passed through the internal channel 28 in the wallet 16, i.e., it is only partially passed through the channel 28 in the wallet 16.

In accordance with the invention, it is necessary to maintain a portion of the insert 10 extending from both ends 20, 24 of the channel 28 in the wallet 16 with these extension portions 18, 22 being subsequently attached to one another to thereby secure the wallet 16, e.g., via a grommet that is arranged in the apertures 14. This state may be achieved by techniques other than inserting the insert 10 into one end 24 of the channel 28 until it extends out of the other end 20, and these alternatives are encompassed within the scope of the invention. The result though, i.e., portions of the insert 10 extend outward from both ends 20, 24, is required.

Placement of the insert 10 into the channel 28 in the wallet 16 is coordinated with the placement and/or position of the apertures 14 so that an alignment region 26 on the first portion 18 of the insert 10 includes two apertures 14 and an alignment region 46 on the second portion 22 of the insert 10 includes a single aperture 14 (see FIG. 2). Each alignment region 26, 46 is considered to include the aperture or apertures and surrounding areas.

An important aspect of the invention is that the insert 10 does not extend through the folds of the wallet 16, i.e., between one portion of the wallet 16 and another portion of the wallet 16 separated by a fold 40, as in some conventional wallet packages, see, e.g., Ford '060 described above. Rather, the insert 10 extends through the internal channel 28 that has an opening 30 at the first end 20 of the wallet 16 another opening 32 at the second end 24 of the wallet 16 (see FIGS. 5 and 6).

Once the insert 10 is situated in the position shown in FIG. 2, the alignment regions 26, 46 on the first and second portions 18, 22 of the insert 10 are placed against or alongside one another to cause the apertures 14 to align with one another. More specifically, the insert 10 is folded between the two apertures 14 on the alignment region 26 of the first portion 18 of the insert 10 and the alignment region 46 on the second portion 22 of the insert 10 is placed between the folded alignment region 26 of the first portion 19 of the insert 10 (see FIG. 3). This placement serves to align the three apertures 14 with one another, with the area around the apertures 14 on the alignment region 26 of the first portion 18 of the insert 10 sandwiching the area around the aperture 14 on the alignment region 46 of the second portion 22 of the insert 10. Alternatively, it is possible for the area around apertures 14 on the alignment region 26 to be directly alongside one another, obtained via the fold in the alignment region 26, and then the alignment region 46 is placed outward of the folded alignment region 26.

At the same time as the insert 10 is being folded, the wallet 16 is also being folded, e.g., in half.

Thereafter, the aligned alignment regions 26, 46 are attached to one another. A suspension aperture 34 is formed from the apertures 14 that align with one another and a grommet 36, or similar attachment member, is placed into the suspension aperture 34 (see FIG. 4).

Figure 6:
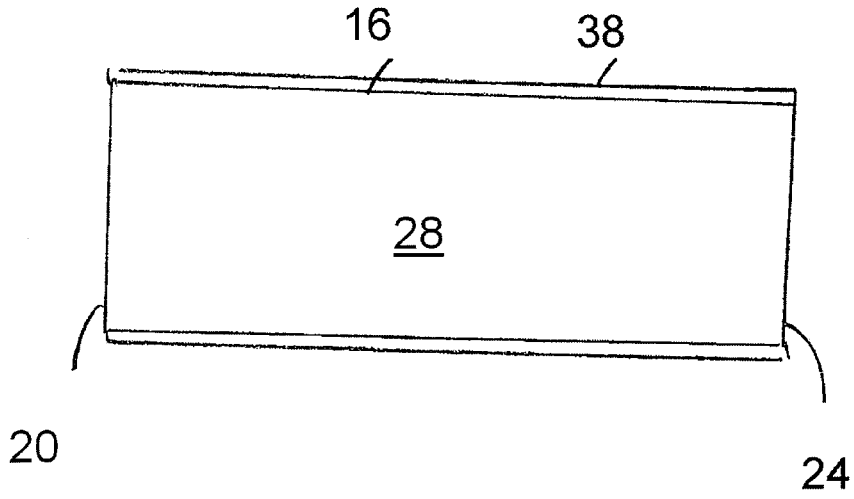
FIG. 6 is a cross-sectional view taken along the line 6-6 in FIG. 5.

As an optional but preferred step, typically performed before the insert 10 is passed through the channel 28 in the wallet 16, the wallet 16 is placed into a tubular sleeve 38 (see FIG. 5). This sleeve 38 is a protective sleeve that is maintained around the wallet 16 in the final packaging for the retail sale. The purchaser of the wallet 16 can remove the sleeve 38 when they remove the insert 10.

Sleeve 38 may alternatively be placed onto the wallet 16. Also, this step may be performed even after the insert 10 is inserted into the channel 28 in the wallet 16.

Sleeve 38 may be a clear plastic sleeve, or made of any transparent material, to enable viewing of the wallet 16 therethrough. A design or other printed matter may be included on the sleeve 38.

As an additional step, the lateral sides 42 of the wallet 16 or the sleeve 38 when present, are attached to one another to secure the wallet 16 in a closed state. Various known attachment mechanisms are considered to be within the scope and spirit of the invention and include, for example, clear stickers 44. The stickers 44 may be of variously shapes, including circular stickers.

In the final state shown in FIG. 4, the packaged wallet may be attached via the grommet 36 to a hook on a display apparatus to be hung thereon or suspended thereby for retail sale.

While the foregoing description and drawings represent the preferred embodiments of the present invention, it will be understood that various changes and modifications may be made without departing from the scope of the present invention.

I claim:

1. A packaging arrangement, comprising:

a wallet having an internal channel; and an insert extending through said channel and having a first portion extending outward from a first end of said wallet and a second portion extending outward from a second end of said wallet opposite to said first end, said first and second portions of said insert each including an alignment region, each of said alignment regions having at least one side face, said side faces of said alignment regions being adjacent one another and said alignment regions being attached to one another via said adjacent side faces, said insert comprising at least one aperture arranged on each of said alignment regions, said apertures in said alignment regions aligning with one another to thereby form a suspension aperture that enables the packaging arrangement to be suspended for retail sale.

2. The packaging arrangement of claim 1, further comprising a sleeve arranged around said wallet.

3. The packaging arrangement of claim 2, wherein said sleeve is made of a transparent material that enables viewing of said wallet.

4. The packaging arrangement of claim 2, wherein said sleeve includes lateral sides, further comprising means for attaching the lateral sides of said sleeve together.

5. The packaging arrangement of claim 1, further comprising a grommet arranged in said suspension aperture.

6. The packaging arrangement of claim 1, wherein said insert comprises two apertures on said alignment region of said first portion and a single aperture on said alignment region of said second portion, said insert being folded between said two apertures on said alignment region of said first portion and said alignment region of said second portion being arranged between the folded alignment region of said first portion to cause said three apertures to align, with said two apertures on said alignment region of said first portion sandwiching said aperture on said alignment region of said second portion.

7. A packaging arrangement, comprising:

a wallet having an internal channel; and an insert extending through said channel and having a first portion extending outward from a first end of said wallet and a second portion extending outward from a second end of said wallet opposite to said first end, said first and second portions of said insert each including an alignment region, wherein said insert comprises two apertures on said alignment region of said first portion and a single aperture on said alignment region of said second portion, said insert being folded between said two apertures on said alignment region of said first portion and said alignment region of said second portion being arranged between the folded alignment region of said first portion to cause said three apertures to align, with said two apertures on said alignment region of said first portion sandwiching said aperture on said alignment region of said second portion, to thereby form a suspension aperture that enables the packaging arrangement to be suspended for retail sale.

8. The packaging arrangement of claim 7, further comprising a sleeve arranged around said wallet.

9. The packaging arrangement of claim 8, wherein said sleeve is made of a transparent material that enables viewing of said wallet.

10. The packaging arrangement of claim 8, wherein said sleeve includes lateral sides, further comprising means for attaching the lateral sides of said sleeve together.

11. The packaging arrangement of claim 7, further comprising a grommet arranged in said suspension aperture.

* * * * *